United States Patent [19]

Rumsey

[11] Patent Number: 4,801,141

[45] **Date of Patent: * Jan. 31, 1989**

[54] LIGHT AND SOUND PRODUCING BALL

[76] Inventor: Daniel Rumsey, 5520 W. 118th Pl., Inglewood, Calif. 90304

[ * ] Notice: The portion of the term of this patent subsequent to May 5, 2004 has been disclaimed.

[21] Appl. No.: 40,842

[22] Filed: Apr. 21, 1987

[51] Int. Cl.[4] ..... G10H 1/00; G10H 5/04

[52] U.S. Cl. ..... 273/1 E; 273/58 E; 273/58 G; 84/1.01

[58] Field of Search ..... 84/1.01, DIG. 2, DIG. 7, 84/470 R; 273/58 E, 58 F, 1 E, 58 G; 446/408, 409; 200/326, DIG. 18, 61.52

[56] References Cited

U.S. PATENT DOCUMENTS 3,935,669 2/1976 Potrzuski et al. ..... 273/58 G
4,662,260 5/1987 Rumsey ..... 273/58 G

FOREIGN PATENT DOCUMENTS 3438168 4/1986 Fed. Rep. of Germany ..... 273/109

*Primary Examiner*—Maryann Lastova
*Attorney, Agent, or Firm*—Blakely, Sokoloff, Taylor & Zafman

[57] ABSTRACT

The present invention is a light producing ball which produces a light in one or more areas of the ball depending upon the orientation of the ball with respect to gravity. A tone generator and speaker are included with the ball to provide unique audio tones for each orientation of the device. Switches and timers are provided to control the volume output and rate of generation of tones and light signals by movement of the ball through a predetermined series of positions, thereby obviating the need for external switches. Automatic turn-on and shut-off is provided to increase power source life.

10 Claims, 2 Drawing Sheets

LIGHT AND SOUND PRODUCING BALL

BACKGROUND OF THE INVENTION

1. Field of the Invention

This invention relates to the field of toys and amusement devices.

2. BACKGROUND ART

In the prior art, there are several examples of toy balls which will produce light when activated. For example, Deyer, U.S. Pat. No. 3,304,651 discloses a toy ball which is intermittantly illuminated as a result of movement of the ball. Smith, U.S. Pat. No. 3,458,205 discloses an illuminable game ball in which the surface of the ball is illuminated from within, with the illumination being selectively activated by means of a switch. Sinclair, European Pat. No. 07,937-A discloses a puzzle cube having translucent faces and light sources behind each face to cause illumination as the cube is turned about axis normal to the faces. In addition, there has been disclosed in U.S. patent application No. 727,836 entitled Sound Producing Ball, a toy ball which will produce different pitches and tones of sound response to different orientations of the ball by a user.

It is an object of the present invention to provide a toy ball which will produce various lights, depending upon the orientation of the ball by the user.

An additional object of the present invention is to provide a ball which produces lights and tones in a repeatable fashion, depending upon the orientation of the ball by the user.

It is a further object of the present invention to provide a ball in which the rate of generation of lights and/or sounds may be set by the user without the use of external switches.

It is still a further object of the present invention to provide a toy ball in which the volume of sounds produced by the ball may be adjusted by the user without the use of external switches.

SUMMARY OF THE PRESENT INVENTION

The present invention is a light producing ball which produces a light in one or more areas of the ball depending upon the orientation of the ball with respect to gravity. Sound producing means are included with the ball to provide unique audio tones for each orientation of the device. Switching and timing means are provided to control the volume output and rate of generation of tones and light signals by movement of the ball through a predetermined series of positions, thereby obviating the need for external switches. Automatic turn-on and shutoff means are provided to increase power source life.

DETAILED DESCRIPTION OF THE PRESENT INVENTION

A ball is described which in a preferred embodiment produces tones of varying pitch and light depending on the orientation of the ball to a reference. In the following description, many specific details are set forth, such as number of tones, number of lights, etc. in order to provide a more thorough understanding of the present invention. It will be obvious, however, to one skilled in the art, that the present invention may be practiced without these specific details. In other instances, well known circuits have not been described in detail in order not to unnecessarily obscure the present invention.

Figure 1:
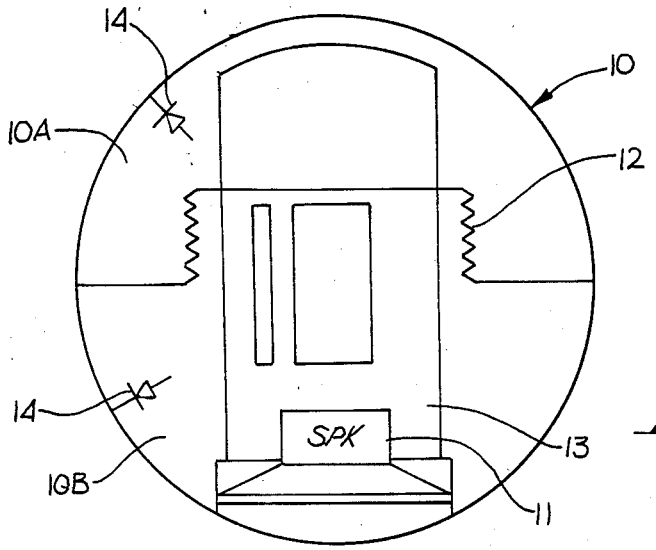
FIG. 1 is a plan view of the toy ball of the present invention illustrating a circuit board, speaker means and illuminating means disposed therein.

The preferred embodiment of the present invention is illustrated in FIG. 1. A toy ball 10 is formed as a hollow sphere with bottom section 10B removeably coupled top section 10A. In the preferred embodiment, section 10B includes threaded portion 12 which threadedly engages a complimentary portion of section 10A.

A circuit board 13 is disposed within the hollow sphere 10 and includes orientation detecting circuitry, sound generation circuitry, light generation circuitry and switching circuitry. It is desired that member 13 be balanced and centered so as not to introduce eccentric motion into the ball 10 unless such is desired. A speaker means 11 is mounted within toy ball 10 for producing a audio output of tones of varying pitch in response to different orientation of the ball 10.

A plurality of illumination means are disposed on the inner surface of toy ball 10. By way of example, a pair of light emitting diodes 14 are shown disposed on the inner surface of light ball 10 of FIG. 1. The preferred embodiment of the present invention utilizes eight light sources disposed o the inner surface of the toy ball 10. However, it will be obvious, that any number of light sources may be utilized without departing from the scope of the present invention. Although not shown in FIG. 1, light sources such as light emitting diodes 14 are electrically connected to circuit board 13. In the preferred embodiment of the present invention, toy ball 10 is comprised of a translucent material so as to permit the illumination of the surface of the toy ball by means of the light sources disposed inside. Marking means are employed on the outside of the ball to identify desired sections of the ball corresponding to different orientations of the ball with respect to gravity and, if desired, to provide different colors to the different identified sections. If desired, portions of the material forming the ball 10 may be colored or tinted to provide identifying sections. In addition, only a portion of the toy ball 10 may be translucent if desired.

Figure 2:
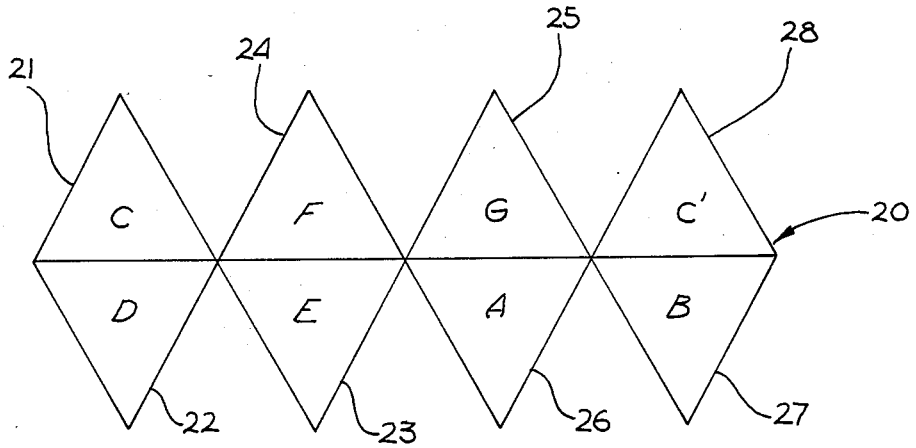
FIG. 2 illustrates the preferred embodiment of the external markings of the toy ball of the present invention.

One marking scheme for the toy ball of FIG. 10 is illustrated in FIG. 2. The marking 20 is shown as being unfolded. When wrapped around ball 10, marking 20 would divide ball 10 into eight equal sections 21–28. As previously mentioned, in the preferred embodiment of the present invention there are eight light means disposed on the inner surface of ball 10. One light means corresponds with each separate section 21–28 of marking 20. In addition, it is desired that a unique tone be associated with each orientation of the ball corresponding to one of sections 21–28. In one embodiment, the pitch of tones produced by the toy ball chosen so as to represent one octave in the musical scale. For example, each section may represent a note in a scale as follows:

| SECTION | NOTE |
|---|---|
| 21 | C |

-continued

| SECTION | NOTE |
|---|---|
| 22 | D |
| 23 | E |
| 24 | F |
| 25 | G |
| 26 | A |
| 27 | B |
| 28 | C |

It is not required to have octave division of the tones produced by the toy ball of the present invention. Any number of tones in a pitch may be utilized without departing from the scope of the present invention.

Figure 3:
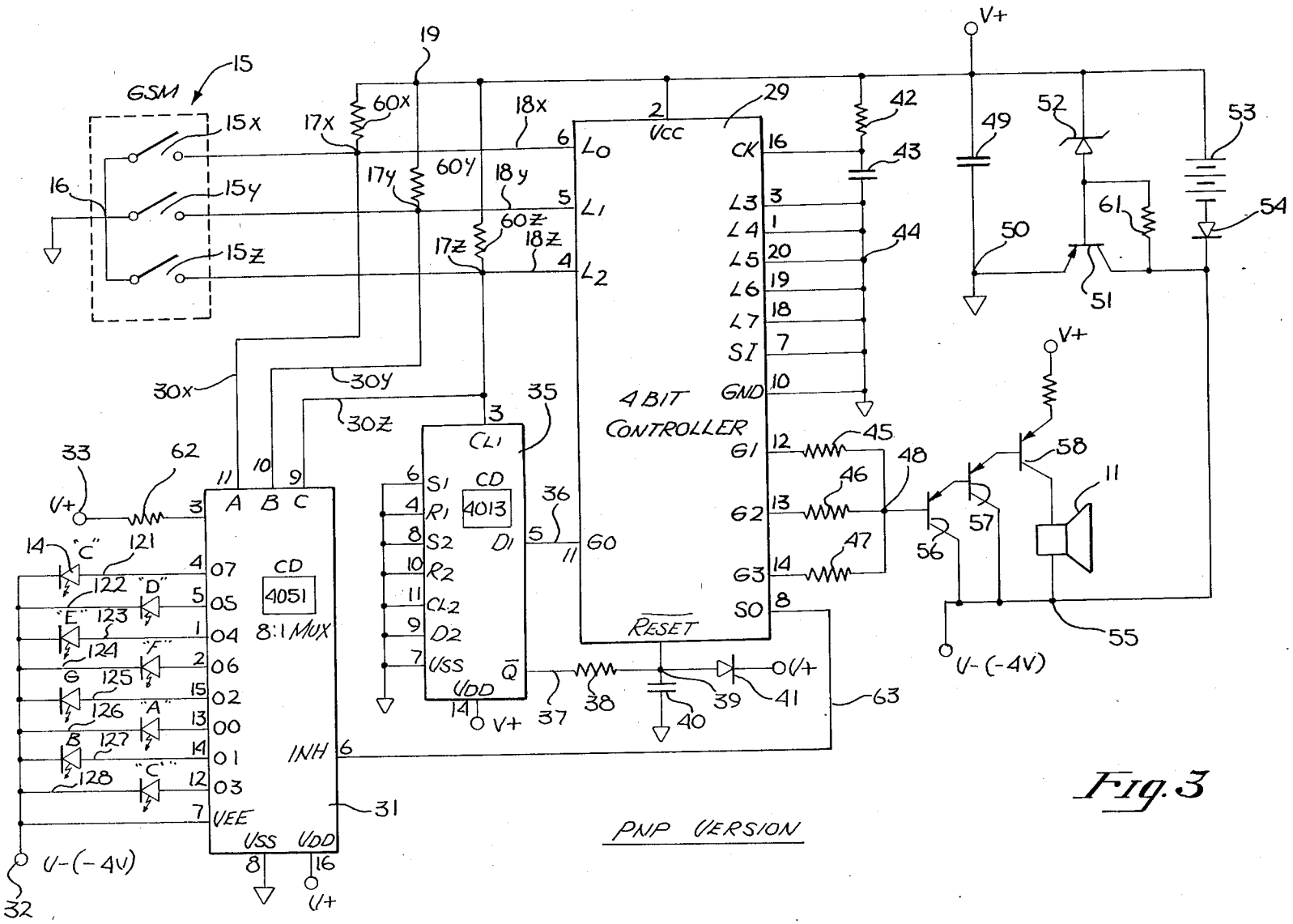
FIG. 3 is a circuit diagram illustrating the circuitry of the preferred embodiment of the present invention.

The circuitry of the preferred embodiment of the present invention is illustrated in FIG. 3. A gravity switch means 15 is disposed within ball 10 of the present invention. The gravity switch means 15 is utilized to determine the orientation of the switch and correspondingly, of the toy ball 10, with respect to gravity. There are a number of suitable gravity switch means that may be employed, and several of these are described in U.S. Pat. No. 4,662,260 filed on Apr. 26, 1985. In simpliest form, gravity switch means 15 consists of three switches 15X–15Z disposed orthogonally to each other in the manner of an X,Y,Z coordinate system. Each of switches 15X–15Z is a two position switch in which the switch is closed through 180 degrees of rotation and open through the remaining 180 degrees of rotation.

One terminal of each of switches 15X–15Z is grounded at node 16. Switches 15X–15Z provide means of coupling node 16 to node 17X–17Z respectively. In the preferred embodiment, three switches are used so as to permit 8 orientations of the gravity switch means to be defined. This corresponds to the eight defined sections of the toy ball 10 contemplated in the preferred embodiment of the present invention. However, any number of switches, orientations, or divisions may be employed as desired.

Nodes 17X–17Z are coupled to inputs L0–L2 of microcontroller 29. Each of nodes 17X–17Z is also coupled through pullup resistors 60X–60Z to node 19, a voltage source V+ which in the preferred embodiment is approximately 5 volts. Node 19 is coupled to one terminal of a power supply (e.g. a battery) 53 which in the preferred embodiment is a 9 volt battery. Thus, depending on whether switches 15X–15Z are open or closed, a logical "1" or logical "0" will exist at nodes 17X–17 Z 17Z and be inputted to microcontroller 29. Microcontroller 29 determines which of 8 possible inputs exist at inputs L0–L2.

Node 19 is also coupled through resistor 42 to the clock input of microcontroller 29 and through capacitor 43 to node 44. Node 44 is tied to the L3–L7 inputs of microcontroller 29 as well as to SI and ground pins of microcontroller 29. Resistor 42 and capacitor 43 form an R/C timing circuit.

The output of microcontroller 29 is a signal whose frequency is dependent upon the signal at inputs L0–L2 and thus dependent on the orientation of gravity switch means 15 with respect to gravity. The output of microcontroller 29 on outputs G1–G3 is coupled through resistors 45, 46 and 47 respectively to node 48. The signal at node 48 is coupled through the base of transistor 56 to node 55, which is one terminal of speaker 11. The emitter of transistor 56 is coupled to the base of transistor 57. The emitter of transistor 57 is coupled to the base of transistor 58, and the emitter of transistor 58 is coupled to resistor 59 through voltage source V+. The collector of transistor 58 is coupled to the ground terminal of speaker 11 while the collector of transistor 57 is coupled to node 55. Node 55 is also coupled through diode 54 to power supply 53 and to a V− signal.

Resistors 45–47 and transistors 56–58 permit volume control of the audio output of speaker 11. The output of microcontroller 29 may appear at any combination of outputs G1–G3. As will be described below, the volume control is operated by a specific rotation sequence so as not to require the use of external switches on the toy ball 10.

Power supply 53 is also coupled through diode 54 to the collector of transistor 51. The collector of transistor 51 is coupled to the base of transistor 51 through resistor 61. The base of transistor 51 is coupled through zener diode 52 to node 19. Node 19 is also coupled through capacitor 49 to the emitter of transistor 51 which is also coupled to ground.

Nodes 17X–17Z (the output of switches 15X–15Z) are coupled through lines 30X–30Z to the ABC inputs of multiplexor 31. The "S0" output of microcontroller 29 is coupled on line 63 to the inhibit input of multiplexor 31. Multiplexor 31 has 8 outputs 121–128 corresponding to sections 21–28 of toy ball 10. Each output 121–128 is coupled to an LED 14 and to V−32. V−32 is also coupled to the Vee input of multiplexor 31. V+33 is coupled through resistor 32 to multiplexor 31. The outputs of multiplexor 31 and microcontroller 29 are such that when a section of toy ball 10 is facing upward, the corresponding LED will be illuminated and the audio output associated with that particular section will be produced. For example, when section 22 is facing upward, output line 122 of multiplexor 31 will be high, illuminating LED 14 coupled to line 122. Also, microcontroller 29 will output a signal so that a tone corresponding to a "D" will be produced by speaker 11.

The signal at node 17Z is also coupled to the CL input of flip flop 35. The S1, S2, R1, R2, CL2, D2 and Vss inputs are all tied to ground on flip flop 35. Input D1 is coupled through line 36 to the G0 output of microcontroller 29. The output $\overline{Q}$ of flip flop 35 is coupled through resistor 38 to node 39. Node 39 is coupled to the reset pin of microcontroller 29, through capacitor 40 to ground, and through diode 41 to V+. Thus, when switch 15Z is closed, and node 17Z is high, output $\overline{Q}$ will be the opposite of the input D1. When switch 15Z is open, the signal at node 17Z is low, so that the output $\overline{Q}$ of flip flop 35 will not change.

Microcontroller 29 is programmed, so that in conjunction with flip flop 35 and switches 15X–15Z, syncopation levels, volume levels, and octave shifts may be achieved without the use of external switches. The syncopation level refers to the length of time of production of a tone at each ball orientation. In the preferred embodiment of the present invention, the following sequence is utilized to provide selection of syncopation levels. The toy ball 10 is first rotated so that section 21 is facing upward. The ball is held in that position until the tone produced stops (time out). The ball 10 is then shifted so that section 22 faces upward. Again the ball is held in this position until the tone corresponding to section number 22 is produced and stops. This sequence causes the microcontroller 29 to initiate a cycle in which the sound alternates between two tones with a varying delay or dead time between the tones. When a delay of desired dead time length is produced, the user rotates ball 10 to "set" the syncopation level of the toy ball.

To set the volume level, a similar series of steps is undertaken with the ball moved from section 21 to section 24. The microcontroller 29 then causes the ball to cycle through tones of different volume levels until the desired volume level is produced. At that point, the ball is rotated again to set the volume level. The volume level is set by means of resistors 45, 47 and transistor 56–58. Depending upon which resistors 45–47 or combination of resistors 45–47 are active dependent on the outputs of the controller, the signal at node 48 will cause a particular level of current drive to transistors 56–58. Therefore, the voltage supplied to speaker 11 from voltage source V+ through resistor 59 and transistor 58 is dependent on the signal at node 48 and correspondingly to the activation of resistors 45–47.

Octave levels may be set between a selection of two octaves by first positioning the toy ball so that section 21 faces upward and then rotating the ball so that section 28 faces upward. Microprocessor 29 is programmed so that after that sequence is initiated, the processor will go to the other octave.

Automatic on and off is provided by means of switches 15X–15Z and flip flop 35. Flip flop 35 transfers the complement of the data input (line 36) to the Q output (line 37) during a positive going transition of a clock pulse on input CL1 (taken from node 17Z). When there has been no input (change in state of switches 15X–15Z) for a fixed period of time (approximately 2 seconds) the tone stops and line 63 goes high, stopping the light output. If still no change occurs for a longer time, microcontroller 29 outputs a high signal on output GO on line 36 to flip flop 35 and goes into a sleep low power mode. When the toy ball is reactivated (rotated again), clock pulses into flip-flop 35, node 17Z, occur due to transitions of switch 15Z. The first clock pulse into flip-flop 35 will reset controller 29 causing line GO of microcontroller 29 to go low, so that data input D1 of flip-flop 35 is now low also. The second clock pulse into flip-flop 35 causes a high signal at the $\overline{Q}$ output on line 37. This takes microcontroller 29 completely out of the sleep mode, activating it for use. Thus, a sound producing ball has been described which produces tones of varying pitch and light corresponding to the orientation of a gravity switch with respect to gravity. The present invention permits the user to create repeatable sequences sounds and tones by positioning the ball according to a plurality of divisions indicated on the surface of the ball.

I claim:

1. A light and sound producing device comprising:

supporting shell means including at least two (2) removably connected sections;

speaker means mounted within said shell means;

a power source mounted within said shell means;

a plurality of light generating means mounted within said shell means;

a plurality of switches electrically coupled to said power source, the state of any one of said switches being dependent upon the orientation of each of said switches to a reference, each of said switches mounted to said shell means at a different orientation than any other of said switches;

decoding means coupled to said switches for determining the state of each of said switches, said decoding means producing a unique signal for each combination of states of said switches, each of said signals having a unique frequency, said decoding means coupled to said speaker means and said light generating means, each of said signals producing an audible tone in said speaker of a frequency corresponding to the frequency of said signal and activating one of said plurality of light generating means;

control means coupled to said switches and said decoding means, said control means producing a first signal when the state of said switches remains constant for a first amount of time, said first signal for disabling said decoding means;

whereby different sounds are produced and different lights are activated when the orientation of said shell to said reference is altered.

2. The device as defined by claim 1 wherein each of said plurality of light generating means comprises a light emitting diode (LED).

3. A sound and light producing device comprising:

supporting shell means including at least two (2) removably connected sections;

speaker means mounted within said shell means;

a power source mounted within said shell means;

a plurality of light generating means mounted within said shell means;

a plurality of switches electrically coupled to said power source, the state of any one of said switches being dependent upon the orientation of each of said switches to a reference, each of said switches mounted to said shell means at a different orientation than any other of said switches;

decoding means coupled to said switches for determining the state of each of said switches, said decoding means producing a unique signal for each combination of states of said switches, each of said signals having a unique frequency, corresponding to a tone of a musical scale, said decoding means coupled to said speaker means, each of said signals producing an audible tone in said speaker of a frequency corresponding to a tone of a musical scale and activating one of said plurality of light generating means;

control means coupled to said switches and said decoding means, said control means producing a first signal when the state of said switches remains constant for a first amount of time, said first signal for disabling said decoding means;

whereby various tones of a musical scale are produced and different lights are activated when the orientation of said shell to said reference is altered.

4. The device as defined by claim 3 wherein each of said plurality of light generating means comprises a light emitting diode (LED).

5. The device as defined by claim 3 wherein said plurality of switches comprises three (3) switches disposed orthogonally to each other.

6. The device as defined by claim 3 wherein said decoding means comprises a microcontroller.

7. The device as defined by claim 6 wherein said control means comprises a flip flop coupled to said plurality of switches and to a reset pin of said microcontroller.

8. The device as defined by claim 6 wherein said microcontroller controls the frequency of said audible tone produced by said device, said microcontroller altering said frequency in response to a predetermined sequence of orientations of said plurality of switches.

9. The device as defined by claim 6 further including volume limiting means for controlling the volume of said audio output, said volume limiting means coupled to said microcontroller, said microcontroller causing said volume limiting means to limit said volume in response to a predetermined sequence of orientations of said plurality of switches.

10. The device as described by claim 6 further including timing means for controlling the length of delay between audible tones produced by said device, said timing means coupled to said microcontroller, said microcontroller causing said timing means to set said length of delay between said audible tones in response to a predetermined sequence of orientation of said plurality of switches.

* * * * *

UNITED STATES PATENT AND TRADEMARK OFFICE

CERTIFICATE OF CORRECTION

PATENT NO. : 4,801,141

DATED : 01/31/89

INVENTOR(S) : Rumsey

It is certified that error appears in the above-identified patent and that said Letters Patent is hereby corrected as shown below:

| COLUMN | LINE | DESCRIPTION |
|---|---|---|
| 2 | 32 | delete "o" insert --on-- |
| 5 | 26 | delete "Q" insert --$\overline{Q}$-- |
| 3 | 49 | delete "17 Z" |

Signed and Sealed this

Twenty-sixth Day of December, 1989

*Attest:*

JEFFREY M. SAMUELS

*Attesting Officer*

*Acting Commissioner of Patents and Trademarks*